US008200108B2

(12) United States Patent
Bray et al.

(10) Patent No.: US 8,200,108 B2
(45) Date of Patent: Jun. 12, 2012

(54) DYNAMIC DONOR LOADING CONTROL FOR DEVELOPMENT SYSTEM

(75) Inventors: Daniel M. Bray, Rochester, NY (US); Joseph C. Sheflin, Macedon, NY (US); Laurie M. Ciroula, Webster, NY (US); Patrick J. Howe, Fairport, NY (US); William H. Wayman, Ontario, NY (US); Palghat S. Ramesh, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 281 days.

(21) Appl. No.: 12/780,034

(22) Filed: May 14, 2010

(65) Prior Publication Data

US 2011/0280606 A1 Nov. 17, 2011

(51) Int. Cl.
*G03G 15/08* (2006.01)

(52) U.S. Cl. ..... 399/53; 399/281

(58) Field of Classification Search ..... 399/53, 399/254, 255, 281
See application file for complete search history.

(56) References Cited

U.S. PATENT DOCUMENTS

| | | | | |
|---|---|---|---|---|
| 6,032,004 | A | 2/2000 | Mirabella, Jr. et al. | |
| 6,694,111 | B1 * | 2/2004 | Hirano | 399/55 |
| 7,257,338 | B2 | 8/2007 | Yoshida | |
| 7,512,366 | B1 | 3/2009 | Beachner et al. | |
| 7,831,182 | B2 * | 11/2010 | Konishi et al. | 399/281 |
| 2008/0285993 | A1 | 11/2008 | Ishida | |
| 2009/0016755 | A1 | 1/2009 | Kellie et al. | |

FOREIGN PATENT DOCUMENTS

JP 7253692 10/1995

* cited by examiner

*Primary Examiner* — Hoang Ngo
(74) *Attorney, Agent, or Firm* — Gibb & Riley, LLC

(57) ABSTRACT

A method and apparatus transfer a material from first roller within a container to at least one second roller, and transfer the material from the second roller to at least one third roller. The second roller and the third roller form a loading nip at a location where the second roller is closest to the third roller. The method and apparatus transfer the material from the third roller to at least one recipient device, and measure current flow between the second roller and the third roller using a measurement device. Then, the method alters the relative rotation rate difference between the first roller and the second roller based on the current flow to maintain a predetermined density of the material at the loading nip using a controller.

20 Claims, 4 Drawing Sheets

DYNAMIC DONOR LOADING CONTROL FOR DEVELOPMENT SYSTEM

BACKGROUND AND SUMMARY

Embodiments herein generally relate to devices that utilize rollers to apply material (such as printing devices) and more particularly to a device that determines the material density between rollers based upon the current flow between the rollers.

Modern printing devices utilize development systems to create markings on different forms of media. However, development systems are sensitive to changes in the amount of marking material passing through various locations, such as the donor loading nips. If there is not enough marking material, one of the first image quality defects seen is a reload defect, which appears as a ghost of a previously developed image. To the contrary, if the amount marking material is too much, the system will experience motor faults or material loss from the housing due to a flow failure.

To prevent these conditions, great effort is spent to achieve the required gaps and material flow. However, the amount of marking material can sometimes be unstable because the material flow varies with changes in toner concentration, toner age, and developer age. The result of this is that gaps and flows need to be selected to prevent failures at the most demanding conditions. Unfortunately, this will deliver poor performance at other noise conditions, particularly very low toner concentrations and low toner ages.

In order to address such situations, with embodiments herein the reload performance can be predicted using a measurement of the current flow through the magnetic roll to donor roll loading nip. Specifically, in one embodiment, a non-printing current measurement is performed during machine cycle-up and cycle-out. The result of the current measurement is then used to change the speed of the material delivery magnetic roll. If the current is below a predetermined amount, the delivery speed is increased slightly, thus increasing the developer density in the loading nips. If the current is above the predetermined limit, the delivery magnetic roll is slowed down. The current measurement performed by embodiments herein is also used in housing build and manufacture to quickly identify incorrect settings and conditions before the housing is installed in a machine.

One exemplary embodiment herein is any form of apparatus that uses a container storing a material and at least one roller (e.g., a "first" roller) that is in the container, a second roller that is adjacent the container, and that receives the material from the first roller. Further, the apparatus includes at least one additional third roller adjacent the second roller. The second roller transfers the material from the first roller to the third roller and the second roller and the third roller form a loading nip at a location where the second roller is closest to the third roller.

With this apparatus, at least one recipient device is adjacent the third roller. The recipient device receives the material from the third roller. A measurement device is also operatively connected to (e.g., electrically connected to) the second roller and the third roller. The measurement device measures current flow between the second roller and the third roller. The current flow between the second roller and the third roller occurs at the loading nip and provides an indication of a measured density of the material at the loading nip.

Further, a controller is operatively connected to the measurement device, the first roller, the second roller, and the third roller. The controller alters the relative rotation rate difference between the first roller and the second roller based on the current flow to maintain a predetermined density of the material at the loading nip. The controller alters the relative rotation rate difference between the first roller and the second roller by changing a rotational speed of the first roller relative to the second roller.

A more specific embodiment herein comprises a developer apparatus that has a container connected to a housing. The container stores a marking material. At least one supply roller is in the container, and at least one magnetic roller is within the housing. The magnetic roller receives the marking material from the supply roller. At least one donor roller is also within the housing adjacent the magnetic roller. The magnetic roller transfers the marking material from the magnetic roller to the donor roller. The magnetic roller and the donor roller form a loading nip at a location where the magnetic roller is closest to the donor roller. The donor roller transfers the marking material to at least one photoconductor adjacent the housing.

A measurement device is operatively connected to the magnetic roller and the donor roller. Again, the measurement device measures current flow between the magnetic roller and the donor roller. Further, a controller is operatively connected to the measurement device, the supply roller, the magnetic roller, and the donor roller. The controller alters the relative rotation rate difference between the supply roller and the magnetic roller based on the current flow to maintain a predetermined density of the marking material at the loading nip.

Another exemplary embodiment is a printing apparatus that comprises a container storing a marking material and at least one rotating brush contacting the marking material. At least one magnetic roller is adjacent the container. The rotating brush or magnetic supply roller transfers the marking material to the magnetic roller. Further, at least one donor roller is adjacent the magnetic roller. The magnetic roller transfers the marking material from the magnetic roller to the donor roller and the magnetic roller and the donor roller form a loading nip at a location where the magnetic roller is closest to the donor roller.

At least one photoconductor is adjacent the donor roller, and the photoconductor receives the marking material from the donor roller. Additionally, at least one charging device is adjacent the photoconductor. The charging device creates a latent electronic image on the photoconductor. The marking material adheres to the photoconductor at locations of the latent electronic image. A media supply path is positioned to supply sheets of media to the photoconductor. The photoconductor transfers the marking material, as patterned by the latent electronic image, to the sheets of media.

A current measurement device is operatively connected to the magnetic roller and the donor roller. The current measurement device measures current flow between the magnetic roller and the donor roller. A controller is operatively connected to the measurement device, the magnetic roller, and the donor roller. The controller alters the relative rotation rate difference between the supply roller and the magnetic roller based on the current flow to maintain a predetermined density of the marking material at the loading nip.

Stated as a method, one embodiment herein transfers a material from a supply roller to at least one second roller, and transfers the material from the second roller to at least one third roller. The second roller and the third roller form a loading nip at a location where the second roller is closest to the third roller. The method transfers the material from the third roller to at least one recipient device, and measures current flow between the second roller and the third roller using a measurement device. Then, the method alters the relative rotation rate difference between the supply roller and the second roller based on the current flow to maintain a predetermined density of the material at the loading nip using a controller.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, printing devices utilize development systems to create markings on different forms of media; however, development systems are sensitive to changes in the amount of marking material passing through various locations, such as the donor loading nips. The developer packing fraction (density) changes for many reasons including: developer aging, environmental conditions, magnetic brush roll surface aging, and toner concentration. These changes in turn affect reloading the donor when it is in continuous operation, and can lead to reload image quality defects and service calls.

In order to address such issues, the embodiments herein measure the current flow between the conductive magnetic brush and the donor roll as an indicator of the developer packing fraction (as a developer conductivity measurement) and in turn use this information to vary the speed of a developer supply roll to adjust the nip packing fraction or density. Thus, embodiments herein monitor and control the developer mass density in, for example, the magnetic brush donor loading nip for hybrid scavengeless development systems. The current measurement and speed adjustment need not be continuous, as packing fraction changes are usually slow. Therefore, adjustments herein can be made continuously during printing, or can be made during cycle up or cycle out periods (non-printing periods) and can use roll and donor bias levels that are adjusted for robust current measurements.

Figure 1:
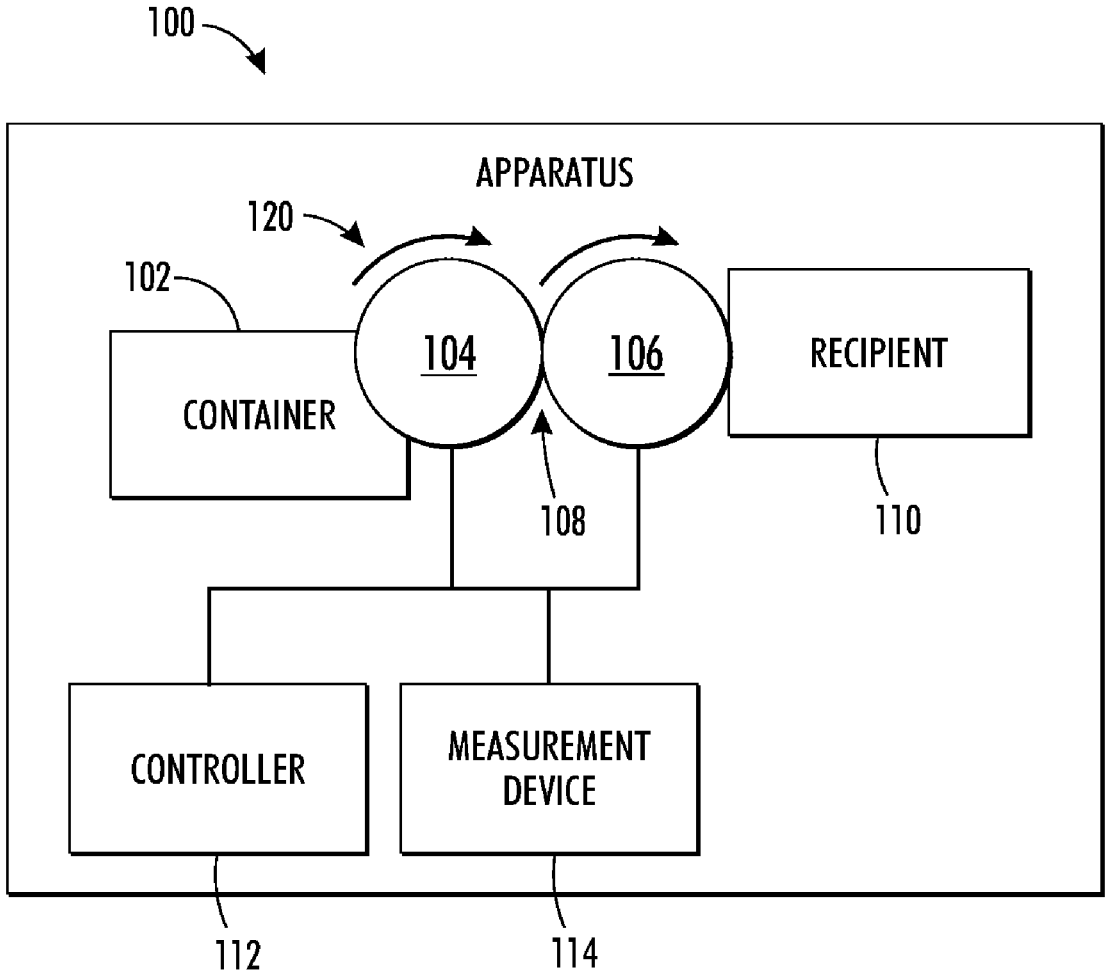
FIG. 1 is a schematic diagram of an apparatus according to embodiments herein.

More specifically, as shown in FIG. 1, one exemplary embodiment herein is any form of apparatus 100 that processes and transports a material 120. The material 120 can comprise any form of material, such as a powder material, granular material, liquid material, aggregate material, etc., that has electrical characteristics that can be detected. While various printer embodiments that process and transport a marking material are discussed below, the embodiment illustrated in FIG. 1 is intended to be applicable to any form of apparatus, and is not limited to printing devices.

The apparatus 100 uses a container 102 storing the material 120 and a first (supply) roller 118 within the container. The container 102 can be included within the apparatus or separate therefrom. At least one roller 104 (e.g., a "second" roller) that is adjacent the container 102, receives the material 120 from the supply roller 118. Further, the apparatus 100 includes at least one additional roller 106 (e.g., "third" roller) adjacent the second roller 104.

The first and third rollers 104, 106 are operatively connected to (directly or indirectly connected to) and rotated by any form of motor including an electrical motor, an internal combustion motor, a compressed air motor, a hydraulic motor, etc. The motor(s) can be directly connected to the rollers 104, 106, 118 or can be indirectly connected to the rollers 104, 106, 118 through gears, hydraulic lines, belts, inductive devices, etc. The first, second and third rollers 118, 104, 106 can be independently operated and rotated at different speeds.

The second roller 104 transfers the material 120 to the third roller 106 and the second roller 104 and the third roller 106 form a loading nip 108 at the location where the second roller 104 is closest to the third roller 106. At least one recipient device 110 is adjacent the third roller 106. The recipient device 110 receives the material 120 from the third roller 106. The recipient device 110 can be included within the apparatus 100 or can be separate therefrom. Further, the recipient device 110 can be another roller, a belt, a sheet of media, an auger, or any other device that can use the material 120 for any purpose.

A measurement device 114 is also operatively connected to (e.g., electrically connected to) the second roller 104 and the third roller 106. The measurement device 114 measures current flow between the second roller 104 and the third roller 106 at the loading nip 108. The current flow between the second roller 104 and the third roller 106 occurs at the loading nip 108 and provides an indication of a measured density of the material 120 at the loading nip 108. The current flow between the second roller 104 and the third roller 106 varies depending upon the density of the material 120 at the loading nip.

Because the electrical characteristics of different materials are often different, each different material that will be transported and processed by the apparatus 100 can be previously evaluated through testing to determine different material densities that correspond to different current flows for each different material. Once such density/current flow "standards" are established for a given material through testing, the embodiments herein only need to measure the current flow to determine the material density within the loading nip 108.

Further, a controller 112 is operatively connected to the measurement device 114, the first roller 118, the second roller 104, and the third roller 106. The controller 112 controls the motors to alter the relative rotation rate difference between the first roller 118 and the second roller 104 (based on the current flow) so as to maintain a predetermined density of the material 120 at the loading nip 108. The controller alters the relative rotation rate difference between the first roller 118 and the second roller 104 by changing a rotational speed of the first roller 118 relative to the second roller 104.

Thus, for example, if the density of the material 120 is above the predetermined limit within the loading nip 108 (as determined by the current flow between the second roller 104 and the third roller 106) the controller could slow the rotation of the first roller 118 while maintaining the existing rotation rate of the second roller 104. This would allow the third roller 106 to remove material 120 at the same rate from the loading nip 108, while the second roller 104 delivers material 120 at a lower rate to the loading nip 108 (thereby decreasing the density of material within the loading nip 108).

Conversely if the density of the material 120 is below a predetermined limit, the controller could increase the rotation of the first roller 118 while maintaining the rotational rate of the second roller 104 to cause material to be delivered at a higher rate to the loading nip 108, while material is being removed at the same rate from the loading nip 108, thereby increasing the density of the material 120 within the loading nip 108.

Alternatively, as would be understood by those ordinarily skilled in the art, the rotational rate of the first roller 118 could be maintained while the rotational rate of the second roller 104 is altered by the controller to increase or decrease the rate at which material is removed from the loading nip 108. Similarly, the rotational rate of one roller could be increased and the rotational rate of the other roller could be simultaneously decreased to achieve the same result.

While the apparatus illustrated in FIG. 1 includes a single container, a single first roller 118, a single second roller 104, a single third roller 106, and a single recipient 110, as would be understood by those ordinarily skilled in the art, the apparatus 100 could include multiples of such items and the drawing is intended to convey both a single set of rollers and recipients, and multiple sets of rollers and recipients.

Figure 2:
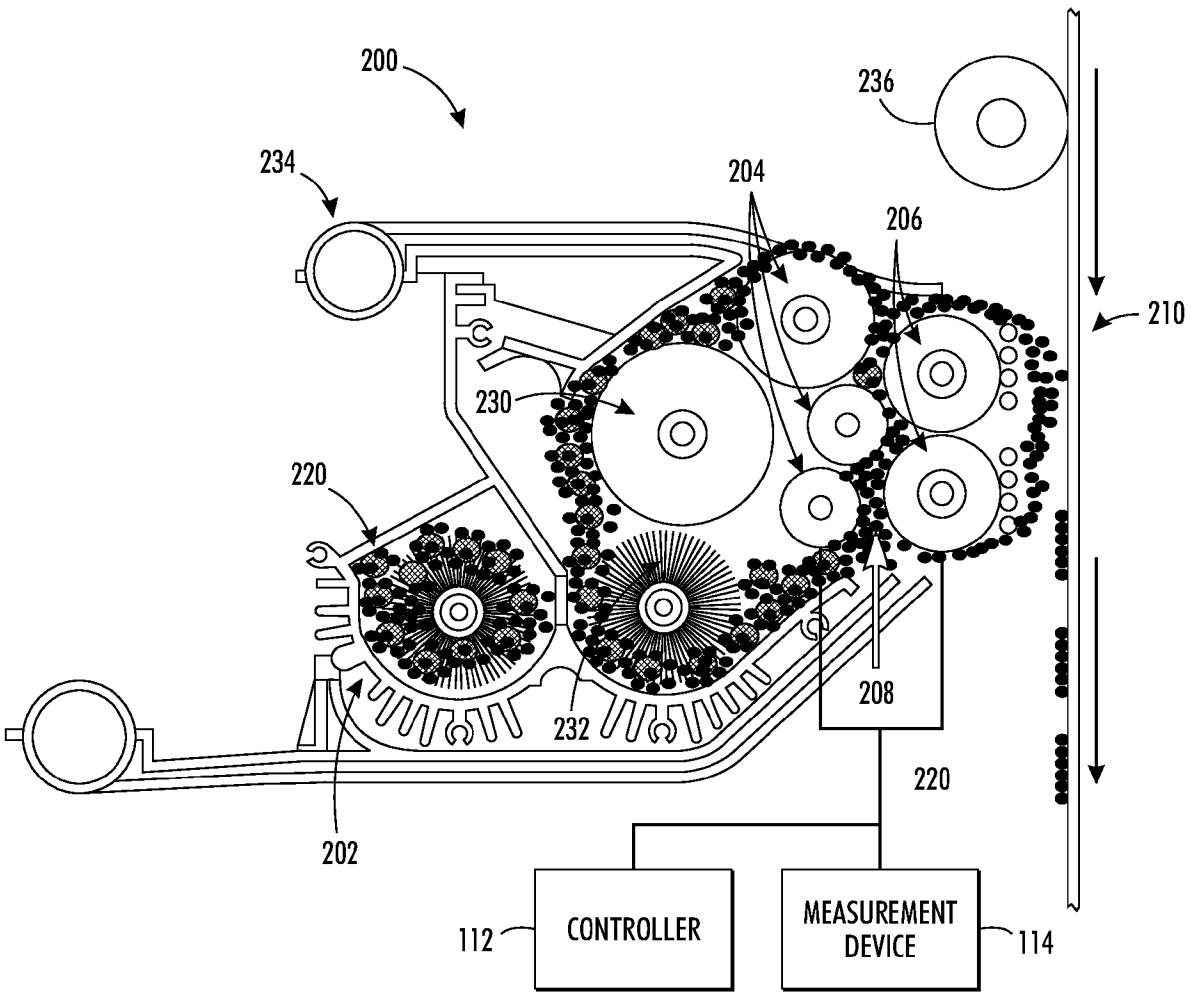
FIG. 2 is a schematic diagram of a developer apparatus according to embodiments herein.

Another embodiment, illustrated in FIG. 2, comprises a developer apparatus 200 that has a container 202 connected to (or formed within) a housing 234. The container 202 corresponds to the container 102 discussed above. The container 202 stores a marking material 220, which corresponds to (and has all the characteristics of) the material 120 mentioned above, and can comprise any marking material whether currently known or developed in the future, such as toners, powdered marking agents, powered inks, solid inks, granular marking agents, etc.

Various brushes, augers, or other similar devices 232 feed the marking material 220 from the container 202 to a material supply magnetic roller 230 (that corresponds to, and has all the characteristics of, the first roller 118 mentioned above) within the housing 234. The material supply magnetic roller 230 transfers the marking material 220 to one or more development magnetic rollers 204 (that correspond to, and have all the characteristics of, the second rollers 104 mentioned above). At some points in this disclosure, the material supply magnetic roller 230 and the development magnetic rollers 204 are simply referred to as magnetic rollers.

One or more donor rollers 206 (corresponding to, and having all the characteristics of, the third roller 106 discussed above) are also within the housing 234 adjacent the development magnetic rollers 204. The development magnetic rollers 204 transfer the marking material 220 to the donor rollers 206. The development magnetic rollers 204 and the donor roller 206 form a loading nip 208 at a location where the development magnetic rollers 204 are closest to the donor rollers 206. The donor rollers 206 transfer the marking material 220 to at least one photoconductor 210 adjacent the housing 234. Here, the photoconductor 210 corresponds to (and has all the characteristics of) the recipient device 110 that is discussed in FIG. 1, above. As described above, the recipient device can be included within the apparatus or can be separate therefrom and, in FIG. 2, the photoconductor 210 is separate from the casing 234.

Figure 3:
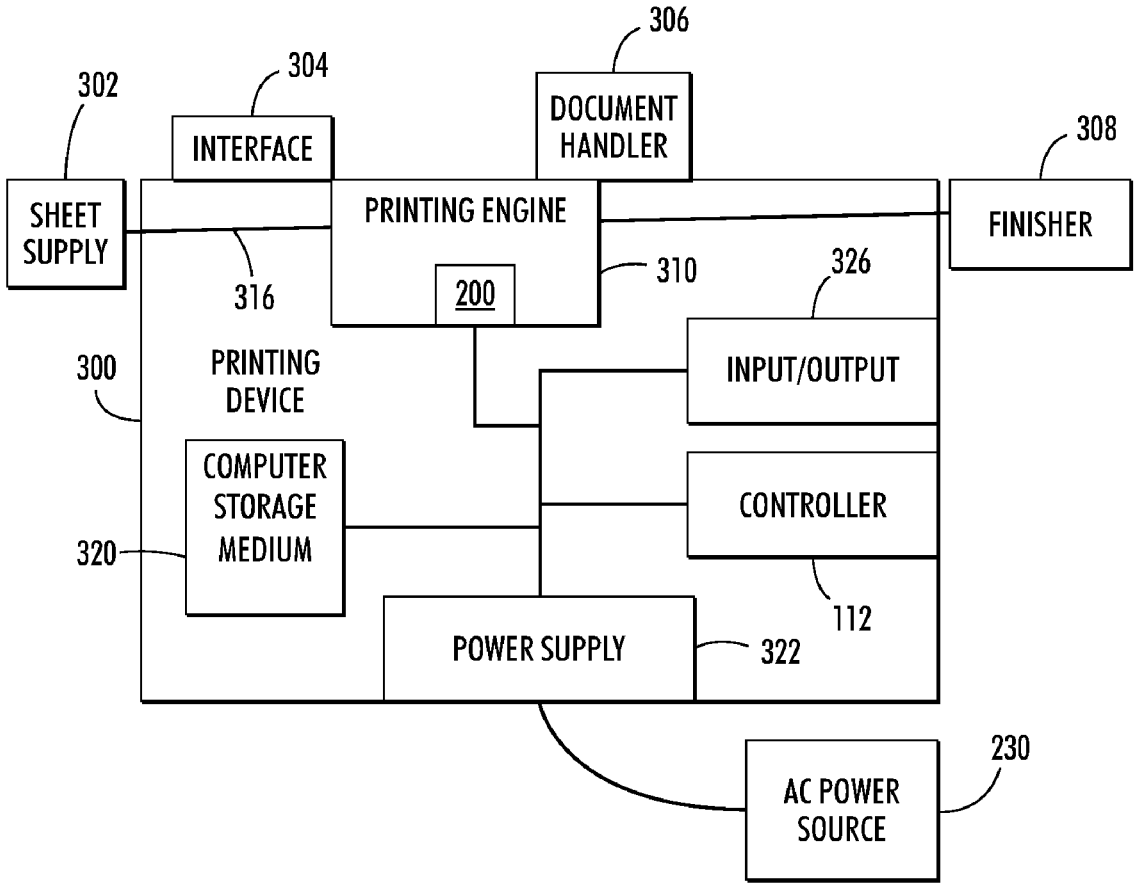
FIG. 3 is a schematic diagram of a printing device according to embodiments herein.

The photoconductor 210 receives the marking material 220 from the donor roller 206. Additionally, at least one charging device 236 is adjacent the photoconductor 210. The charging device 236 creates a latent electronic image on the photoconductor 210. The marking material 220 adheres to the photoconductor 210 at locations of the latent electronic image as shown in FIG. 2. FIG. 3, below, illustrates a media supply path 316 that is positioned to supply sheets of media to the photoconductor 210. The photoconductor 210 transfers the marking material 220, as patterned by the latent electronic image, to the sheets of media.

The measurement device 114 is operatively connected to the development magnetic rollers 204 and the donor rollers 206, in a similar manner as that discussed above with respect to FIG. 1. Here, the measurement device 114 measures current flow between the development magnetic rollers 204 and the donor roller 206. Further, similar to the structure illustrated in FIG. 1, in FIG. 2, the controller 112 is operatively connected to the measurement device 114, the development magnetic rollers 204, and the donor roller 206.

As with the structure illustrated in FIG. 1, the controller 112 alters the relative rotation rate difference between the supply magnetic roller 230 and the development magnetic rollers 204, based on the current flow, to maintain a predetermined density of the marking material 220 at the loading nip 208. As mentioned above, by changing the relative rotation rate difference between the supply magnetic roller 230 and the development magnetic rollers 204, the density of the marking material 220 within the loading nip 208 can be increased or decreased according to the current flow that is measured within the loading nip 208.

Another exemplary embodiment that is illustrated in FIG. 3 is a printing apparatus 300 device embodiment. The printing apparatus 300 comprises, for example, a multi-function printing apparatus that has a graphic user interface 304 operatively connected to the controller 112 that is discussed above. Note that the controller 112 can be part of the apparatus 100 or developer apparatus 200, or be separate therefrom, as shown in FIG. 3. The graphic user interface 304 receives user menu selections.

A document handler 306 can also be operatively connected to the controller 112. The document handler 306 includes a scanner and belts (and/or other media movement devices) that move the sheets by the scanner allowing images to be captured from the sheets and processed according to the menu selections.

In the multi-function printing device shown in FIG. 3, blank sheets of media are supplied from a sheet supply 302 along a paper path 316 to one or more printing engines 310, which include the developer apparatus 200 discussed above, as well as latent image charging devices, photoconductors, transfer nips, fusers, etc. After receiving various markings from the printing engine 310, the sheets of media pass to a finisher 308 which can fold, staple, sort, etc., the various printed sheets. An input/output device 326 is used for communications to and from the multi function printing device 300.

The controller 112 controls the various actions of the printing device 300. The power supply 322 connects to an external alternating current power source 330 and converts the external power into the type of power needed by the various devices mentioned above.

A computer readable storage medium 320 (which can be optical, magnetic, capacitor based, etc.) is readable by the controller 112 and stores instructions that the controller 112 executes to allow the multi-function printing device to perform its various functions, such as those described above. The computer readable storage medium 320 also temporarily stores the image data captured by the document handler 306.

Figure 4:
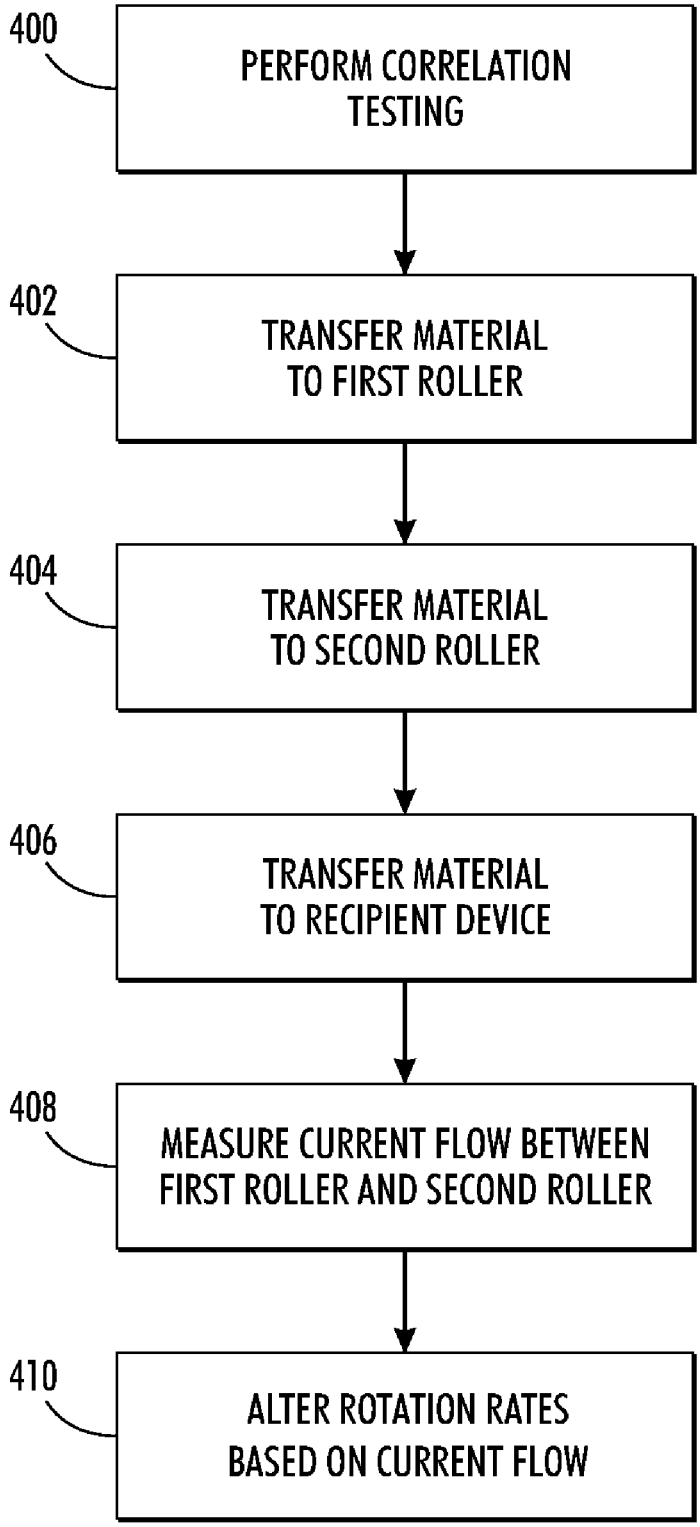
FIG. 4 is a flow diagram of a method according to embodiments herein.

FIG. 4 illustrates some embodiments herein in flowchart form. As shown in flowchart item 400, at some point before performing the active operations described herein, the embodiments perform correlation testing to determine different material densities within the loading nip that correspond to different current flows for a variety of different materials.

The embodiments herein transfer material to at least one first roller in item 402, transfer the material from the first roller to at least one second roller in item 404, and in item 406, transfer the material from the second roller to at least one third roller. As mentioned above, the second roller and the third roller form a loading nip at a location where the second roller is closest to the third roller. The embodiments herein measure current flow between the second roller and the third roller using a measurement device in item 408. Then, in item 410 the method alters the relative rotation rate difference between the first roller and the second roller based on the current flow to maintain a predetermined density of the material at the loading nip.

As mentioned above, image quality defects known as reload can vary as the customer usage changes. Extended low area of coverage runs will raise the mean housing toner age, for example. The factors that tend to drive variations in reload are toner concentration, toner age, and developer age. It should be understood that some of this variation is due to the condition and amount of toner supplied to the donor rolls. It has also been observed that these changes in "material state" will change the way the developer flows in the housing. Great care and energy is spent in the design, testing, and tolerance analysis to ensure adequate performance under all usage conditions; however, this is difficult to achieve because material flow variation is very large. However, with embodiments herein, by measuring the current flowing through the reload nip, the resulting reload performance can be inferred (and adjusted for if needed) because a strong correlation exists between density and current flow.

The current reading mentioned above can be performed at any time. Thus, a reading can be performed during printing run cycles, as well as machine cycle up or cycle out (non-printing time periods). This measurement is used to make speed corrections to the material supply magnetic roll drive motor. With embodiments herein looser gap and part tolerances can be used, as the embodiments herein automatically adjust to the desired operating conditions. The overall result of the dynamic developer flow control provided by embodiments herein is improved image quality stability over all usage conditions. Embodiments herein also provide run cost reductions, because the toner purge cycle can be reduced or eliminated.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. An apparatus comprising:

a container storing a material;

a first roller within said container;

at least one second roller adjacent said container, said second roller receiving said material from said first roller;

at least one third roller adjacent said second roller, said second roller transferring said material from said second roller to said third roller, and said second roller and said third roller forming a loading nip at a location where said second roller is closest to said third roller;

at least one recipient device adjacent said third roller, said recipient device receiving said material from said third roller;

a measurement device operatively connected to said second roller and said third roller, said measurement device measuring current flow between said second roller and said third roller; and a controller operatively connected to said measurement device, said second roller, and said third roller, said controller altering a relative rotation rate difference between said first roller and said second roller based on said current flow to maintain a predetermined density of said material at said loading nip.

2. The apparatus according to claim 1, said current flow providing an indication of a measured density of said material at said loading nip.

3. The apparatus according to claim 1, said controller altering said relative rotation rate difference between said first roller and said second roller by changing a rotational speed of said first roller relative to said second roller.

4. The apparatus according to claim 1, said measurement device being electrically connected to said second roller and said third roller.

5. The apparatus according to claim 1, said current flow between said second roller and said third roller occurring at said loading nip.

6. A developer apparatus comprising:

a housing;

a container connected to said housing, said container storing a marking material;

a supply roller within said container;

at least one magnetic roller within said housing adjacent said container, said magnetic roller receiving said marking material from said supply roller;

at least one donor roller within said housing adjacent said magnetic roller, said magnetic roller transferring said marking material from said magnetic roller to said donor roller, said magnetic roller and said donor roller forming a loading nip at a location where said magnetic roller is closest to said donor roller, and said donor roller transferring said marking material to at least one photoconductor adjacent said housing;

a measurement device operatively connected to said magnetic roller and said donor roller, said measurement device measuring current flow between said magnetic roller and said donor roller; and a controller operatively connected to said measurement device, said supply roller, said magnetic roller, and said donor roller, said controller altering a relative rotation rate difference between said supply roller and said magnetic roller based on said current flow to maintain a predetermined density of said marking material at said loading nip.

7. The developer apparatus according to claim 6, said current flow providing an indication of a measured density of said marking material at said loading nip.

8. The developer apparatus according to claim 6, said controller altering said relative rotation rate difference between said supply roller and said magnetic roller by changing a rotational speed of said supply roller relative to said donor roller.

9. The developer apparatus according to claim 6, said measurement device being electrically connected to said magnetic roller and said donor roller.

10. The developer apparatus according to claim 6, said current flow between said magnetic roller and said donor roller occurring at said loading nip.

11. A printing apparatus comprising:

a container storing a marking material;

at least one rotating brush contacting said marking material;

at least one magnetic roller adjacent said container, said rotating brush transferring said marking material to said magnetic roller;

at least one donor roller adjacent said magnetic roller, said magnetic roller transferring said marking material from said magnetic roller to said donor roller, and said magnetic roller and said donor roller forming a loading nip at a location where said magnetic roller is closest to said donor roller;

at least one photoconductor adjacent said donor roller, said photoconductor receiving said marking material from said donor roller;

at least one charging device adjacent said photoconductor, said charging device creating a latent electronic image on said photoconductor, said marking material adhering to said photoconductor at locations of said latent electronic image;

a media supply path positioned to supply sheets of media to said photoconductor, said photoconductor transferring said marking material, as patterned by said latent electronic image, to said sheets of media;

a measurement device operatively connected to said magnetic roller and said donor roller, said measurement device measuring current flow between said magnetic roller and said donor roller; and a controller operatively connected to said measurement device, said rotating brush, said magnetic roller, and said donor roller, said controller altering a relative rotation rate difference between said rotating brush and said magnetic roller based on said current flow to maintain a predetermined density of said marking material at said loading nip.

12. The printing apparatus according to claim 11, said current flow providing an indication of a measured density of said marking material at said loading nip.

13. The printing apparatus according to claim 11, said controller altering said relative rotation rate difference between said rotating brush and said magnetic roller by changing a rotational speed of said rotating brush relative to said magnetic roller.

14. The printing apparatus according to claim 11, said measurement device being electrically connected to said magnetic roller and said donor roller.

15. The printing apparatus according to claim 11, said current flow between said magnetic roller and said donor roller occurring at said loading nip.

16. A method comprising:

transferring a material from a first roller to at least one second roller;

transferring said material from said second roller to at least one third roller, said second roller said third roller forming a loading nip at a location where said second roller is closest to said third roller;

transferring said material from said third roller to at least one recipient device;

measuring current flow between said second roller and said third roller using a measurement device; and altering a relative rotation rate difference between said first roller and said second roller based on said current flow to maintain a predetermined density of said material at said loading nip using a controller.

17. The method according to claim 16, said current flow providing an indication of a measured density of said material at said loading nip.

18. The method according to claim 16, said altering of said relative rotation rate difference between said first roller and said second roller being controlled by said controller by changing a rotational speed of said first roller relative to said second roller.

19. The method according to claim 16, said measurement device being electrically connected to said second roller and said third roller.

20. The method according to claim 16, said current flow between said second roller and said third roller occurring at said loading nip.

* * * * *